US011898752B2

(12) United States Patent
Nath et al.

(10) Patent No.: US 11,898,752 B2
(45) Date of Patent: Feb. 13, 2024

(54) THERMO-ACOUSTIC DAMPER IN A COMBUSTOR LINER

(71) Applicant: General Electric Company, Schenectady, NY (US)

(72) Inventors: Hiranya Nath, Bengaluru (IN); Ravindra Shankar Ganiger, Bengaluru (IN); Michael A. Benjamin, Cincinnati, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/932,332

(22) Filed: Sep. 15, 2022

(65) Prior Publication Data

US 2023/0366547 A1 Nov. 16, 2023

(30) Foreign Application Priority Data

May 16, 2022 (IN) ..... 202211027976

(51) Int. Cl.
*F23R 3/00* (2006.01)
*F23M 20/00* (2014.01)

(52) U.S. Cl.
CPC ..... *F23R 3/002* (2013.01); *F23M 20/005* (2015.01); *F23R 2900/00014* (2013.01); *F23R 2900/03042* (2013.01)

(58) Field of Classification Search
CPC ..... F23R 3/002; F23R 2900/00014; F23R 2900/03042; F23M 20/005; F01N 1/023
See application file for complete search history.

(56) References Cited

U.S. PATENT DOCUMENTS 5,465,572 A 11/1995 Nicoll et al.
6,041,590 A 3/2000 Hayton et al.
7,104,065 B2 * 9/2006 Benz ..... F23M 20/005 60/725
7,334,408 B2 * 2/2008 Bethke ..... F23R 3/002 60/725

(Continued)

FOREIGN PATENT DOCUMENTS

EP 1221574 A2 7/2002
EP 3156731 A2 4/2017

*Primary Examiner* — Gerald L Sung
*Assistant Examiner* — Rene D Ford
(74) *Attorney, Agent, or Firm* — Venable LLP; Michele V. Frank

(57) ABSTRACT

A hollow plank of a combustor liner defining a combustion chamber including an inner wall having a plurality of inner openings and one or more inner holes, an outer wall having one or more outer openings and a plurality of outer holes, a plurality of lateral walls coupled to the inner wall and the outer wall to define a cavity, and a partition wall connected to the plurality of lateral walls and dividing the cavity into a first sub-cavity and a second sub-cavity. The one or more outer openings communicate with the first sub-cavity and communicate through a plurality of tubes with the second sub-cavity. The plurality of inner openings communicate with the second sub-cavity and communicate with the first sub-cavity through one or more bypass tubes. The first sub-cavity or the second sub-cavity, or both, are frequency tuned to reduce combustion dynamic frequencies.

20 Claims, 11 Drawing Sheets

(56) References Cited

U.S. PATENT DOCUMENTS

| | | | | |
|---|---|---|---|---|
| 7,832,211 | B2 * | 11/2010 | Ikeda | F23R 3/04 60/725 |
| 8,839,624 | B2 * | 9/2014 | Schnell | F23R 3/002 60/725 |
| 8,931,589 | B2 * | 1/2015 | Bothien | F23M 20/005 181/219 |
| 8,991,185 | B2 * | 3/2015 | Huber | F23M 20/005 60/725 |
| 9,121,610 | B2 | 9/2015 | Lam | |
| 10,145,561 | B2 * | 12/2018 | Stoia | F02C 3/04 |
| 10,508,808 | B2 | 12/2019 | Drake | |
| 10,546,070 | B2 * | 1/2020 | Hellat | G06F 30/00 |
| 10,935,244 | B2 | 3/2021 | Kostka et al. | |
| 11,143,401 | B2 | 10/2021 | Moura et al. | |
| 11,454,133 | B2 * | 9/2022 | Hafner | F01D 25/14 |
| 2013/0042627 | A1 | 2/2013 | Gerendas et al. | |
| 2016/0370008 | A1 | 12/2016 | Drake et al. | |
| 2017/0343216 | A1 * | 11/2017 | McMahan | F23R 3/286 |
| 2021/0372620 | A1 | 12/2021 | Dai et al. | |
| 2023/0033194 | A1 * | 2/2023 | Gralki | F23R 3/46 |

* cited by examiner

THERMO-ACOUSTIC DAMPER IN A COMBUSTOR LINER

CROSS REFERENCE TO RELATED APPLICATIONS

The present application claims the benefit of Indian Patent Application No. 202211027976, filed on May 16, 2022, which is hereby incorporated by reference herein in its entirety.

TECHNICAL FIELD

The present disclosure relates generally to combustor liners and, in particular, to a thermo-acoustic damper in a hollow plank of a combustor liner.

BACKGROUND

A gas turbine engine generally includes a fan and a core arranged in flow communication with one another, with the core disposed downstream of the fan in the direction of flow through the gas turbine engine. The core of the gas turbine engine generally includes, in serial flow order, a compressor section, a combustion section, a turbine section, and an exhaust section.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Figure 1:
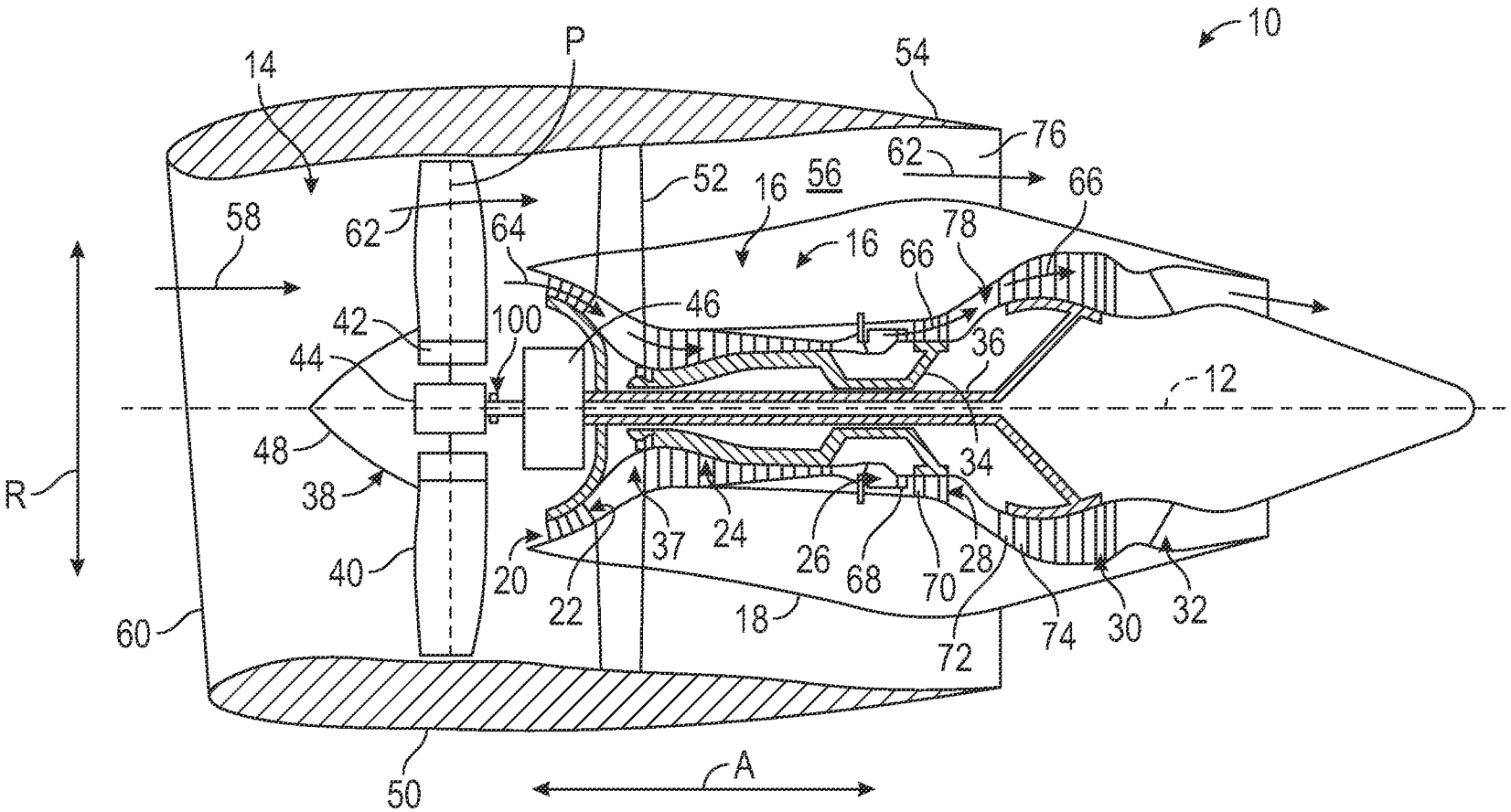
FIG. 1 is a schematic cross-sectional diagram of a turbine engine, according to an embodiment of the present disclosure.

Additional features, advantages, and embodiments of the present disclosure are set forth or apparent from a consideration of the following detailed description, drawings, and claims. Moreover, it is to be understood that both the foregoing summary of the present disclosure and the following detailed description are exemplary and intended to provide further explanation without limiting the scope of the disclosure as claimed.

Various embodiments of the present disclosure are discussed in detail below. While specific embodiments are discussed, this is done for illustration purposes only. A person skilled in the relevant art will recognize that other components and configurations may be used without departing from the spirit and the scope of the present disclosure.

In the following specification and the claims, reference may be made to a number of "optional" or "optionally" elements meaning that the subsequently described event or circumstance may occur or may not occur, and that the description includes instances in which the event occurs and instances in which the event does not occur.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged. Such ranges are identified and include all the sub-ranges contained therein unless context or language indicates otherwise.

As may be used herein, the terms "axial" and "axially" refer to directions and orientations that extend substantially parallel to a centerline of the turbine engine or the combustor. Moreover, the terms "radial" and "radially" refer to directions and orientations that extend substantially perpendicular to the centerline of the turbine engine or the fuel-air mixer assembly. In addition, as used herein, the terms "circumferential" and "circumferentially" refer to directions and orientations that extend arcuately about the centerline of the turbine engine or the fuel-air mixer assembly.

With multi-shaft gas turbine engines, the compressor section can include a high pressure compressor (HPC) disposed downstream of a low pressure compressor (LPC), and the turbine section can similarly include a low pressure turbine (LPT) disposed downstream of a high pressure turbine (HPT). With such a configuration, the HPC is coupled with the HPT via a high pressure shaft (HPS), and the LPC is coupled with the LPT via a low pressure shaft (LPS). In operation, at least a portion of air over the fan is provided to an inlet of the core. Such a portion of the air is progressively compressed by the LPC and then, by the HPC until the compressed air reaches the combustion section. Fuel is mixed with the compressed air and burned within the combustion section to produce combustion gases. The fuel that mixed with the compressed air and burned within the combustion section is delivered to the combustion section through a fuel nozzle. The combustion gases are routed from the combustion section through the HPT and then, through the LPT. The flow of combustion gases through the turbine section drives the HPT and the LPT, each of which in turn drives a respective one of the HPC and the LPC via the HPS and the LPS. The combustion gases are then routed through the exhaust section, e.g., to atmosphere. The LPT drives the LPS, which drives the LPC. In addition to driving the LPC, the LPS can drive the fan through a power gearbox, which allows the fan to be rotated at fewer revolutions per unit of time than the rotational speed of the LPS for greater efficiency.

As will be further described in detail in the following paragraphs, a combustor is provided with improved liner durability under a harsh heat and stress environment. The combustor includes a skeleton mesh structure (also referred to as a hanger or a truss) on which are mounted an inner liner and an outer liner. The skeleton mesh structure acts as a supporting structure for the inner liner and the outer liner as a whole. In an embodiment, the skeleton mesh structure can be made of metal. The skeleton mesh structure together with the inner liner and the outer liner define the combustion chamber. The inner liner and the outer liner include a plurality of planks. The plurality planks cover at least the inner side of the skeleton mesh structure. In an embodiment, the plurality of planks can be made of a ceramic material, a Ceramic Matrix Composite (CMC) material, or a metal coated with CMC or a Thermal Barrier Coating (TBC). In an embodiment, the plurality of planks are exposed to hot flames. Each of the plurality of planks is hollow and includes an inner wall and an outer wall. The plurality of planks that are hollow provide liner protection in case of primary face distress due to hot gases. The skeleton mesh structure together with the plurality of planks can improve durability by reducing or substantially eliminating hoop stress while providing a lightweight liner configuration for the combustor. In addition, the use of the plurality of planks together with the skeleton mesh structure provides a modular or a segmented configuration that facilitates manufacturing and/or inspection, servicing and replacement of individual planks. In addition, the space inside each of the hollow planks can be subdivided into two or more cavities so as to form, for example, a dual layer of cavities to dampen combustion dynamics pressure oscillations. Various configurations can be used for tuning the hollow plank cavities to dampen a wide range of frequencies effectively. Furthermore, at least one of the cavities in the two or more cavities within the space inside each of the hollow planks acts as a damper. For example, both cavities within the plank can be tuned to act as a damper simultaneously and tuned to reduce a broad range of combustion dynamics frequencies. Every plank in the plurality of planks can be provided with the acoustics damping feature. Alternatively, one or more selected planks in the plurality of planks can be provided with the acoustics damping feature. Any combination is possible to target a range of frequencies.

FIG. 1 is a schematic cross-sectional diagram of a turbine engine 10, according to an embodiment of the present disclosure. More particularly, for the embodiment shown in FIG. 1, the turbine engine 10 is a high-bypass turbine engine. As shown in FIG. 1, the turbine engine 10 defines an axial direction A (extending parallel to a longitudinal centerline 12 provided for reference) and a radial direction R, generally perpendicular to the axial direction A. The turbine engine 10 includes a fan section 14 and a core turbine engine 16 disposed downstream from the fan section 14. The term "downstream" is used herein in reference to air flow direction 58.

The core turbine engine 16 depicted generally includes an outer casing 18 that is substantially tubular and that defines an annular inlet 20. The outer casing 18 encases, in serial flow relationship, a compressor section including a booster or a low pressure compressor (LPC) 22 and a high pressure compressor (HPC) 24, a combustion section 26, a turbine section including a high pressure turbine (HPT) 28 and a low pressure turbine (LPT) 30, and a jet exhaust nozzle section 32. A high pressure shaft (HPS) 34 drivingly connects the HPT 28 to the HPC 24. A low pressure shaft (LPS) 36 drivingly connects the LPT 30 to the LPC 22. The compressor section, the combustion section 26, the turbine section, and the jet exhaust nozzle section 32 together define a core air flow path 37.

For the embodiment depicted, the fan section 14 includes a fan 38 with a variable pitch having a plurality of fan blades 40 coupled to a disk 42 in a spaced apart manner. As depicted, the fan blades 40 extend outwardly from the disk 42 generally along the radial direction R. Each fan blade 40 is rotatable relative to the disk 42 about a pitch axis P by virtue of the fan blades 40 being operatively coupled to a suitable actuation member 44 configured to collectively vary the pitch of the fan blades 40 in unison. The fan blades 40, the disk 42, and the actuation member 44 are together rotatable about the longitudinal centerline 12 (longitudinal axis) by the LPS 36 across a power gear box 46. The power gear box 46 includes a plurality of gears for adjusting or controlling the rotational speed of the fan 38 relative to the LPS 36 to a more efficient rotational fan speed.

The disk 42 is covered by a rotatable front hub 48 aerodynamically contoured to promote an air flow through the plurality of fan blades 40. Additionally, the fan section 14 includes an annular fan casing or a nacelle 50 that circumferentially surrounds the fan 38 and/or at least a portion of the core turbine engine 16. The nacelle 50 may be configured to be supported relative to the core turbine engine 16 by a plurality of circumferentially-spaced outlet guide vanes 52. Moreover, a downstream section 54 of the nacelle 50 may extend over an outer portion of the core turbine engine 16 so as to define a bypass air flow passage 56 therebetween.

During operation of the turbine engine 10, a volume of air flow 58 enters the turbine engine 10 in air flow direction 58 through an associated inlet 60 of the nacelle 50 and/or the fan section 14. As the volume of air passes across the fan blades 40, a first portion of the air as indicated by arrows 62 is directed or routed into the bypass air flow passage 56 and a second portion of the air as indicated by arrow 64 is directed or routed into the core air flow path 37, or, more specifically, into the LPC 22. The ratio between the first portion of air indicated by arrows 62 and the second portion of air indicated by arrows 64 is commonly known as a bypass ratio. The pressure of the second portion of air indicated by arrows 64 is then increased as it is routed through the HPC 24 and into the combustion section 26, where it is mixed with fuel and burned to provide combustion gases 66.

The combustion gases 66 are routed through the HPT 28 where a portion of thermal energy and/or kinetic energy from the combustion gases 66 is extracted via sequential stages of HPT stator vanes 68 that are coupled to the outer casing 18 and HPT rotor blades 70 that are coupled to the HPS 34, thus, causing the HPS 34 to rotate, thereby supporting operation of the HPC 24. The combustion gases 66 are then routed through the LPT 30 where a second portion of thermal and kinetic energy is extracted from the combustion gases 66 via sequential stages of LPT stator vanes 72 that are coupled to the outer casing 18 and LPT rotor blades 74 that are coupled to the LPS 36, thus, causing the LPS 36 to rotate, thereby supporting operation of the LPC 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass air flow passage 56 before it is exhausted from a fan nozzle exhaust section 76 of the turbine engine 10, also providing propulsive thrust. The HPT 28, the LPT 30, and the jet exhaust nozzle section 32 at least partially define a hot gas path 78 for routing the combustion gases 66 through the core turbine engine 16.

The turbine engine 10 depicted in FIG. 1 is, however, by way of example only, and that, in other exemplary embodiments, the turbine engine 10 may have any other suitable configuration. In still other exemplary embodiments, aspects of the present disclosure may be incorporated into any other suitable gas turbine engine. For example, in other exemplary embodiments, aspects of the present disclosure may be incorporated into, e.g., a turboshaft engine, a turboprop engine, a turbo-core engine, a turbojet engine, etc.

Figure 2A:
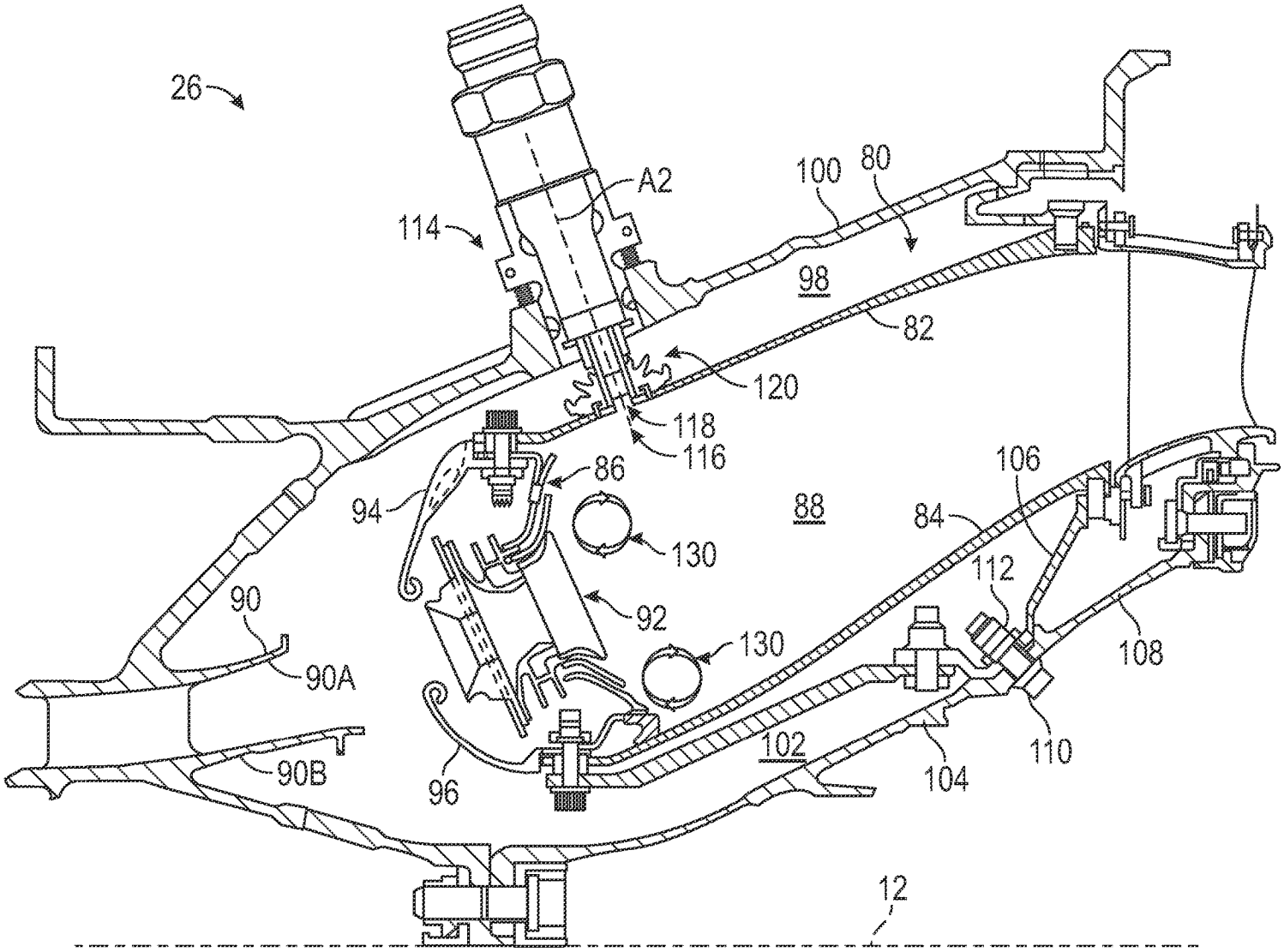
FIG. 2A is a schematic longitudinal cross-sectional view of the combustion section of the turbine engine of FIG. 1, according to an embodiment of the present disclosure.

FIG. 2A is a schematic, longitudinal cross-sectional view of the combustion section 26 of the turbine engine 10 of FIG. 1, according to an embodiment of the present disclosure. The combustion section 26 generally includes a combustor 80 that generates the combustion gases discharged into the turbine section, or, more particularly, into the HPT 28. The combustor 80 includes an outer liner 82, an inner liner 84, and a dome 86. The outer liner 82, the inner liner 84, and the dome 86 together define a combustion chamber 88 that extends around the longitudinal centerline 12. In addition, a diffuser 90 is positioned upstream of the combustion chamber 88. The diffuser 90 has an outer diffuser wall 90A and an inner diffuser wall 90B. The inner diffuser wall 90B is closer to a longitudinal centerline 12. The diffuser 90 receives an air flow from the compressor section and provides a flow of compressed air to the combustor 80. In an embodiment, the diffuser 90 provides the flow of compressed air to a single circumferential row of fuel/air mixers 92. In an embodiment, the dome 86 of the combustor 80 is configured as a single annular dome, and the circumferential row of fuel/air mixers 92 is provided within openings formed in the dome 86 (air feeding dome or combustor dome). However, in other embodiments, a multiple annular dome can also be used.

In an embodiment, the diffuser 90 can be used to slow the high speed, highly compressed air from a compressor (not shown) to a velocity optimal for the combustor 80. Furthermore, the diffuser 90 can also be configured to limit the flow distortion as much as possible by avoiding flow effects like boundary layer separation. Similar to most other gas turbine engine components, the diffuser 90 is generally designed to be as light as possible to reduce weight of the overall engine.

A fuel nozzle (not shown) provides fuel to fuel/air mixers 92 depending upon a desired performance of the combustor 80 at various engine operating states. In the embodiment shown in FIG. 2A, an outer cowl 94 (e.g., an annular cowl) and an inner cowl 96 (e.g., an annular cowl) are located upstream of the combustion chamber 88 so as to direct air flow into fuel/air mixers 92. The outer cowl 94 and the inner cowl 96 may also direct a portion of the flow of air from the diffuser 90 to an outer passage 98 defined between the outer liner 82 and an outer casing 100 and an inner passage 102 defined between the inner liner 84 and an inner casing 104. In addition, an inner support cone 106 is further shown as being connected to a nozzle support 108 using a plurality of bolts 110 and nuts 112. Other combustion sections, however, may include any other suitable structural configuration.

The combustor 80 also includes an igniter 114. The igniter 114 is provided to ignite the fuel/air mixture supplied to combustion chamber 88 of the combustor 80. The igniter 114 is attached to the outer casing 100 of the combustor 80 in a substantially fixed manner. Additionally, the igniter 114 extends generally along an axial direction A2, defining a distal end 116 that is positioned proximate to an opening in a combustor member 120 of the combustion chamber 88. The distal end 116 is positioned proximate to an opening 118 within the outer liner 82 of the combustor 80 to the combustion chamber 88.

In an embodiment, the dome 86 of the combustor 80, together with the outer liner 82, the inner liner 84, and the fuel/air mixers 92, provide for a swirling flow 130 in the combustion chamber 88. The air flows through the fuel/air mixers 92 as the air enters the combustion chamber 88. The role of the dome 86 and the fuel/air mixers 92 is to generate turbulence in the air flow to rapidly mix the air with the fuel. Each of the fuel/air mixers 92 (also called swirlers) establishes a local low pressure zone that forces some of the combustion products to recirculate, as illustrated in FIG. 2, creating needed high turbulence.

Figure 2B:
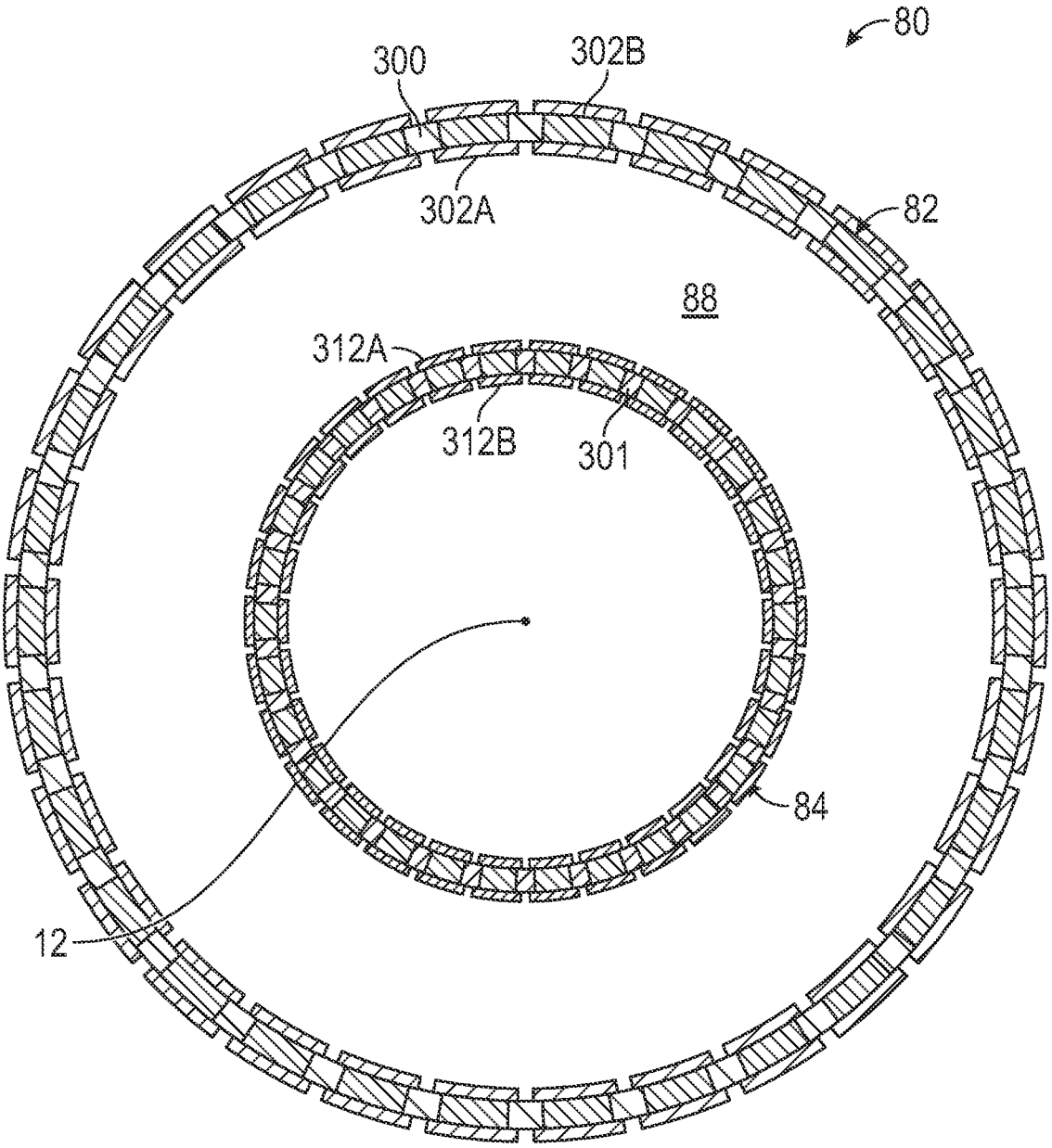
FIG. 2B is a schematic transversal cross-sectional view of the combustor of the turbine engine of FIG. 1, according to an embodiment of the present disclosure.

FIG. 2B is a schematic transversal cross-sectional view of the combustor 80 of the turbine engine 10 of FIG. 1, according to an embodiment of the present disclosure. The combustor 80 includes the outer liner 82 and the inner liner 84, which extend around the turbine centerline 12 to define the combustion chamber 88. The outer liner 82 includes a skeleton mesh structure 300 (also referred to as a hanger or a truss) and a plurality of hot side planks 302A and, optionally, a plurality of cold side planks 302B. The plurality of hot side planks 302A and the plurality of cold side planks 302B are mounted to the skeleton mesh structure 300 (outer mesh structure) of the outer liner 82. The inner liner 84 includes a skeleton mesh structure 301 (inner mesh structure) and a plurality of hot side planks 312A and, optionally, a plurality of cold side planks 312B. The plurality of hot side planks 312A and the plurality of cold side planks 312B are mounted to the skeleton mesh structure 301 of the inner liner 84. The skeleton mesh structure 300 acts as a supporting structure for the hot side planks 302A and the cold side planks 302B of the outer liner 82. The skeleton mesh structure 301 acts as a supporting structure for the hot side planks 312A and the cold side planks 312B of the inner liner 84. In an embodiment, the skeleton mesh structures 300 and 301 are made of metal. The outer liner 82 is shown having generally a cylindrical configuration. The inner liner 84 is similar in many aspects to the outer liner 82. However, the inner liner 84 has a radius of curvature less than a radius of curvature of the outer liner 82.

The plurality of hot side planks 302A are mounted to and cover the inner side of the skeleton mesh structure 300, and the cold side planks 302B are mounted to and cover the outer side of the skeleton mesh structure 300. In this regard, the plurality of hot side planks 302A may be sized and shaped to mesh or to connect together side-to-side and have abutting edges without gaps between adjacent planks 302A. Similarly, the plurality of cold side planks 302B may be sized and shaped to mesh or to connect together side-to-side and have abutting edges without gaps between adjacent planks 302B. In other embodiments, gaps may be provided between adjacent planks 302A, 302B. The plurality of hot side planks 312A are mounted to and cover the outer side of the skeleton mesh structure 301, and the cold side planks 312B are mounted to and cover the inner side of the skeleton mesh structure 301. In this regard, the plurality of hot side planks 312A may be sized and shaped to mesh or to connect together side-to-side and have abutting edges without gaps between adjacent planks 312A. Similarly, the plurality of cold side planks 312B may be sized and shaped to mesh or to connect together side-to-side and have abutting edges without gaps between adjacent planks 312B. In other embodiments, gaps may be provided between adjacent planks 312A, 312B. The plurality of hot side planks 302A of the outer liner 82 and the plurality of hot side planks 312A of the inner liner 84 are exposed to hot flames within the combustion chamber 88. In an embodiment, the plurality of hot side planks 302A, 312A are made of ceramic or are made of metal coated with a ceramic coating or thermal barrier coating to enhance resistance to relatively high temperatures. In an embodiment, the plurality of hot side planks 302A, 312A can be made of a ceramic material, a Ceramic Matrix Composite (CMC) material, or a metal coated with CMC or thermal barrier coating (TBC). In an embodiment, the cold side planks 302B, 312B can be made of a metal or a Ceramic Matrix Composite (CMC). In an embodiment, the cold side planks 302B, 312B are thinner than the plurality of hot side planks 302A, 312A. In an embodiment, as shown in FIG. 2B, both the inner liner 84 and the outer liner 82 are shown having the plurality of hot side planks 302A, 312A, and the plurality of cold side planks 302B, 312B. In another embodiment, the plurality of cold side planks 302B, 312B may be optional for the outer liner 82, for the inner liner 84, or for both.

Figure 3:
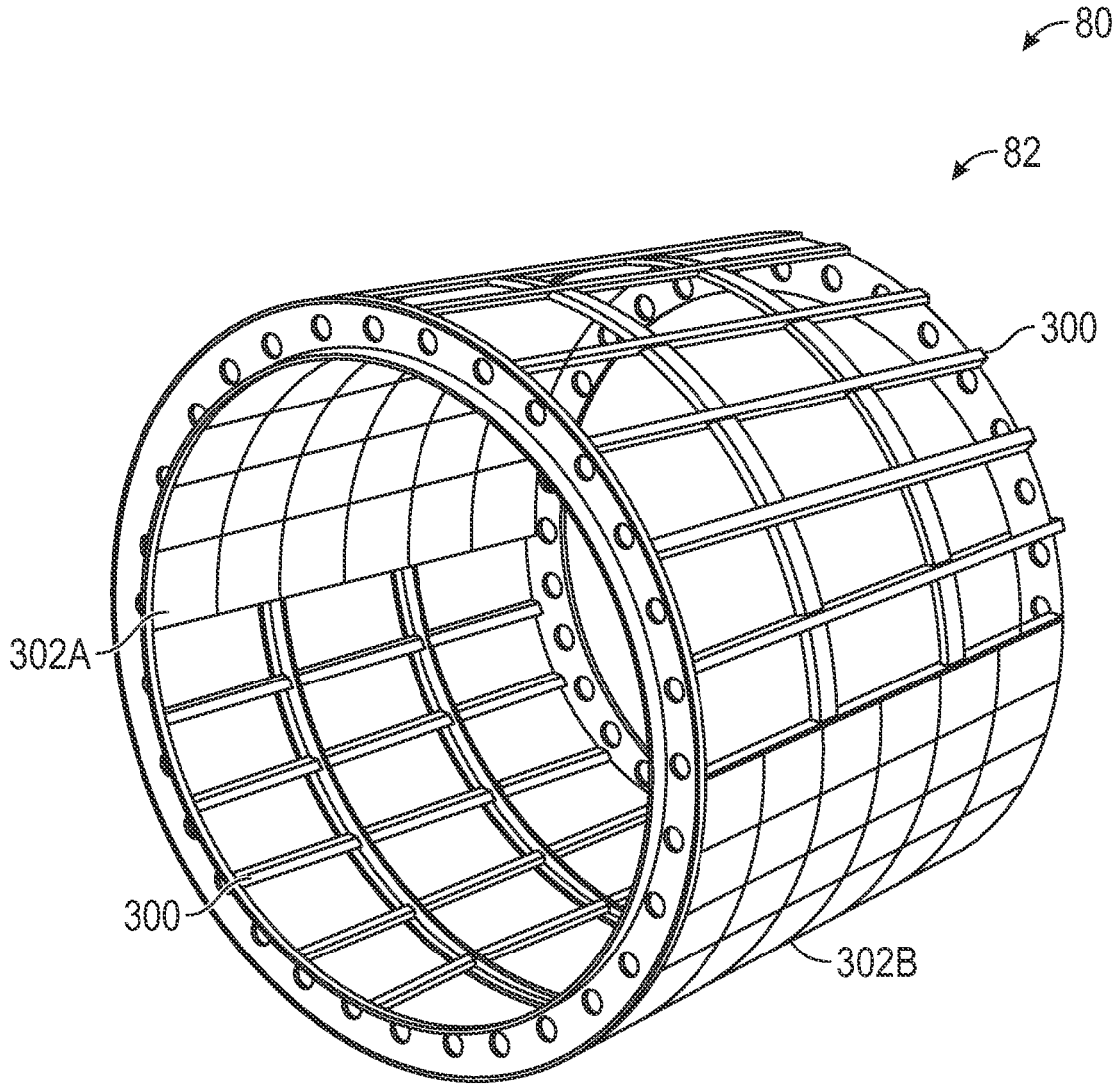
FIG. 3 is a schematic perspective view of an outer liner of the combustor, according to an embodiment of the present disclosure.

FIG. 3 is a schematic perspective view of the outer liner 82 of the combustor 80, according to an embodiment of the present disclosure. In FIG. 3, only the outer liner 82 is shown and the inner liner 84 (FIG. 2) is omitted in this figure for clarity purposes. As shown in FIG. 3, the outer liner 82 comprises the skeleton mesh structure 300 (outer mesh structure) on which are mounted the plurality of hot side planks 302A and the plurality of cold side planks 302B. The plurality of hot side planks 302A and the plurality of cold side planks 302B are mounted to the skeleton mesh structure 300 of the outer liner 82. The skeleton mesh structure 300 acts as a supporting structure for the hot side planks 302A and the cold side planks 302B of the outer liner 82. In an embodiment, the skeleton mesh structure 300 is made of metal. The plurality of hot side planks 302A are mounted to and cover the inner side of the skeleton mesh structure 300, and the cold side planks 302B are mounted to and cover the outer side of the skeleton mesh structure 300. In this regard, as depicted in FIG. 3, the plurality of hot side planks 302A and the plurality of cold side planks 302B may be sized and shaped to mesh together, and have abutting edges without gaps between adjacent planks 302A and 302B. In other embodiments, gaps may be provided between adjacent planks 302A and 302B.

The skeleton mesh structure 300 together with the plurality of hot side planks 302A and, optionally, the plurality of cold side planks 302B can improve durability due to hoop stress reduction or elimination while providing a lightweight liner configuration for the combustor 80. Similarly, the skeleton mesh structure 301 together with the plurality of hot side planks 312A and, optionally, the plurality of cold side planks 312B (FIG. 2) can improve durability due to hoop stress reduction or elimination while providing a lightweight liner configuration for the combustor 80. For example, the present configuration provides at least twenty percent weight reduction as compared to conventional combustors. Furthermore, the present configuration provides the additional benefit of being modular or segmented and, thus, relatively easy to repair. Indeed, if one or more planks in the plurality of hot side planks 302A, 312A or the plurality of cold side planks 302B, 312B is damaged, only the damaged one or more planks is replaced and not the entire inner liner 84 or the entire outer liner 82. Furthermore, the present configuration lends itself to be relatively easy to inspect and to repair. All these benefits result in overall cost savings.

Figure 4:
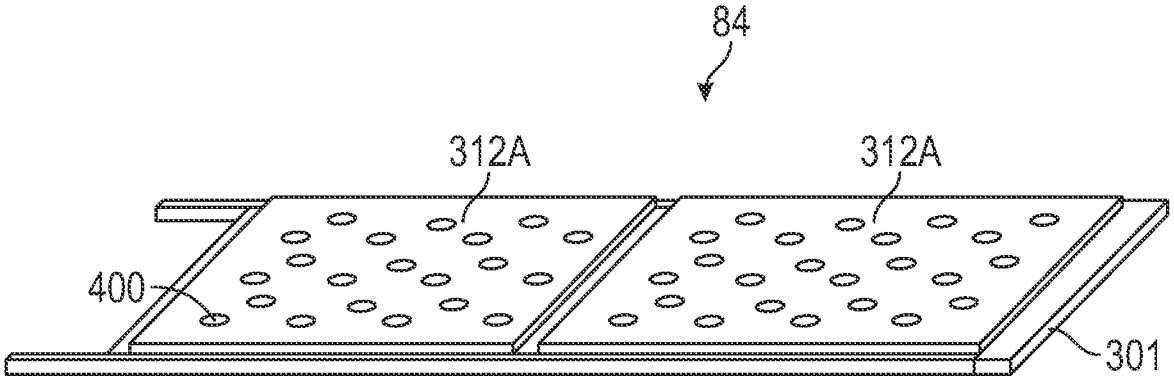
FIG. 4 is a schematic view of a section of an inner liner and an outer liner of the combustor, according to an embodiment of the present disclosure.

FIG. 4 is a schematic view of a section of the inner liner 84 of the combustor 80, according to an embodiment of the present disclosure. As shown in FIG. 4, the plurality of hot side planks 312A are mounted to the skeleton mesh structure 301. The plurality of hot side planks 312A include a plurality of outer holes 400. The plurality of outer holes 400 are distributed along a surface of the plurality of hot side planks 312A to allow air to enter the combustion chamber 88.

Figure 5:
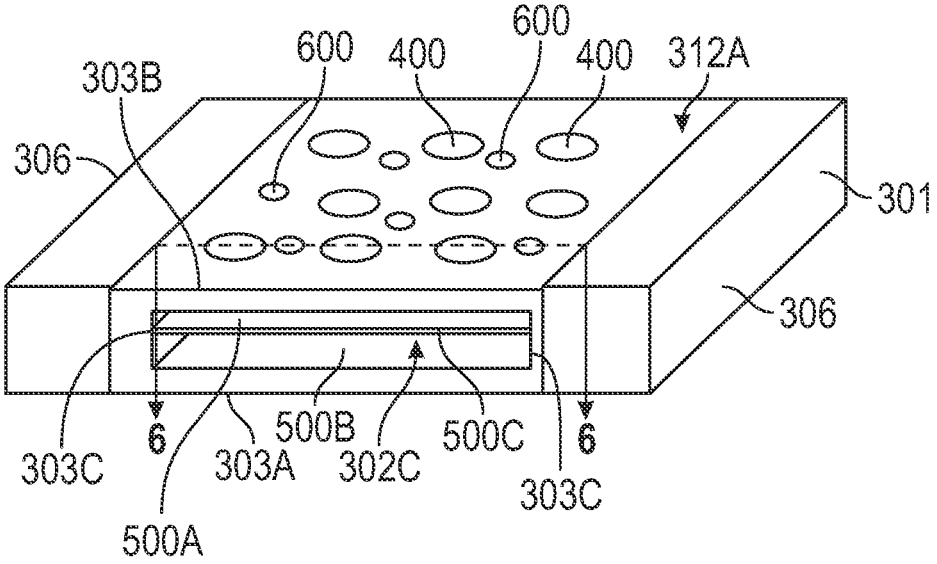
FIG. 5 is a schematic view of one of the plurality of planks mounted to the skeleton mesh structure, according to an embodiment of the present disclosure.

FIG. 5 is a schematic view of one of the plurality of hot side planks 312A mounted to the skeleton mesh structure 301, according to an embodiment of the present disclosure. As shown in FIG. 5, each of the plurality of hot side planks 312A is hollow and includes an inner wall 303A, an outer wall 303B, and lateral walls 303C that define a cavity 302C. The hot side planks 312A can be referred to as "hollow planks." The lateral walls 303C are coupled to the inner wall 303A (hot side wall) and the outer wall 303B (cool side wall). For example, the lateral walls 303C, the inner wall 303A (hot side wall) and the outer wall 303B (cool side wall) can be integrally formed. The plurality of hot side planks 312A that are hollow within the cavity 302C can provide liner protection in case of primary face distress due to hot gases. The skeleton mesh structure 301 can include a plurality of structural elements 306 that connect or mesh together to form the skeleton mesh structure 301 shown in FIG. 4. In an embodiment, each of the plurality of hot side planks 312A is mounted to the plurality of structural elements 306 of the skeleton mesh structure 301. In another embodiment, each of the plurality of hot side planks 312A is mounted between the plurality of structural elements 306 of the skeleton mesh structure 301. In an embodiment, the plurality of outer holes 400 in the plurality of hot side planks 312A perforate the outer wall 303B of the plurality of hot side planks 312A. In an embodiment, the plurality of outer holes 400 communicate with the cavity 302C so as to allow airflow from the outer wall 303B through the plurality of outer holes 400 into the cavity 302C and to allow impingement on inner wall 303A and circulation of airflow inside the cavity 302C to cool down the inner wall 303A that faces the combustion chamber 88 (shown in FIGS. 2A and 2B). The cavity 302C is divided into at least a first sub-cavity 500A and a second sub-cavity 500B using a partition wall 500C. The partition wall 500C is connected to lateral walls 303C. In addition to outer holes 400, the plurality of hot side planks 312A are also provided with plurality of outer openings 600. In an embodiment, the plurality of outer openings 600 are provided in outer wall 303B. The plurality of outer openings 600 communicate with the first sub-cavity 500A to allow airflow to traverse the outer wall 303B through the plurality of outer openings 600 into the first sub-cavity 500A. In addition, as will be described in the following paragraphs, the plurality of outer holes 400 communicate with the second sub-cavity 500B to so as to allow airflow to traverse the outer wall 303B and through the plurality of outer holes 400 into the second sub-cavity 500B. The airflow passing through the plurality of outer holes 400 impinges on the inner wall 303A and provides circulation of airflow inside the second sub-cavity 500B to cool down the inner wall 303A that faces the combustion chamber 88. In an embodiment, the first sub-cavity 500A acts as a thermo-acoustic resonator cavity and the plurality of outer openings 600 are used as inlets to the thermo-acoustic resonator cavity and for providing film cooling of the inner wall 303A.

Figure 6:
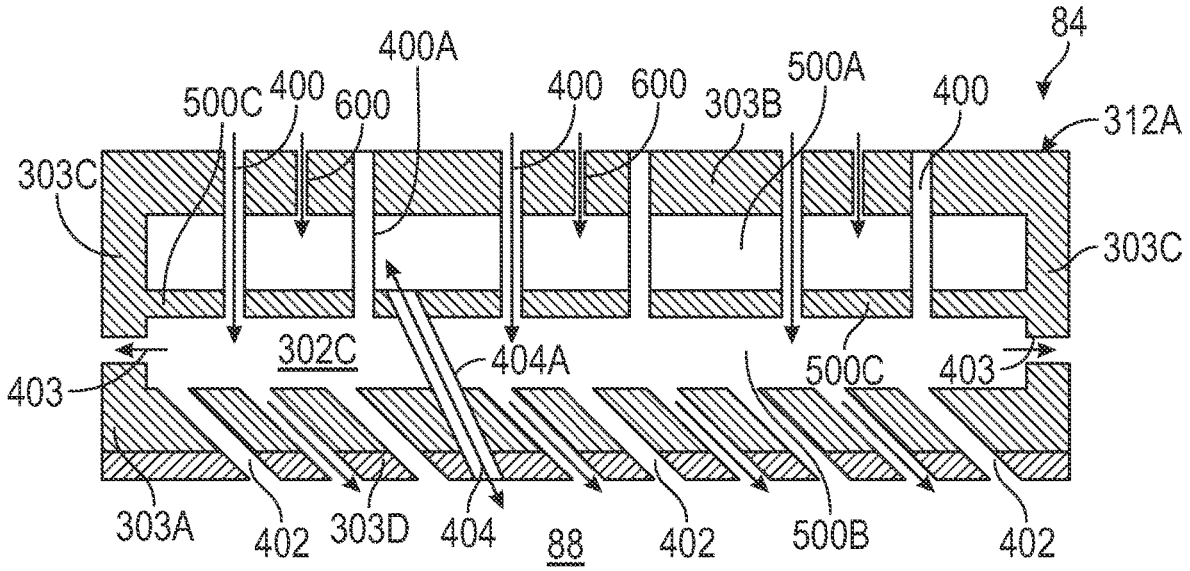
FIG. 6 is schematic cross-sectional view of one of the plurality of planks, along cross-sectional line 6-6 shown in FIG. 5, showing the arrangement of a first sub-cavity and a second sub-cavity, according to an embodiment of the present disclosure.

FIG. 6 is schematic cross-sectional view of one of the plurality of hot side planks 312A, along cross-sectional line 6-6 shown in FIG. 5, showing the arrangement of the first sub-cavity 500A and the second sub-cavity 500B, according to an embodiment of the present disclosure. As shown in FIG. 6, the plurality of hot side planks 312A include the inner wall 303A, the outer wall 303B, and the lateral walls 303C that define the cavity 302C. The plurality of outer holes 400 are provided in the outer wall 303B of the plurality of hot side planks 312A. In addition to the plurality of outer holes 400, a plurality of inner openings 402 are provided in the inner wall 303A of the plurality of planks 312A. In an embodiment, as shown in FIG. 6, the plurality of outer holes 400 in the outer wall 303B of the plurality of hot side planks 312A are orthogonal holes with respect to the outer wall 303B. In an embodiment, the plurality of inner openings 402 in the inner wall 303A of the plurality of hot side planks 312A are oblique holes with respect to the inner wall 303A of the plurality of hot side planks 312A and communicate with the cavity 302C. As shown in FIG. 6, the cavity 302C is divided into at least the first sub-cavity 500A and the second sub-cavity 500B using the partition wall 500C. The partition wall 500C is connected to lateral walls 303C. In addition to outer holes 400 and inner openings 402, the hot side plank 312A is also provided with the plurality of outer openings 600. In an embodiment, the plurality of outer openings 600 are provided in the outer wall 303B. The plurality of outer openings 600 communicate with the first sub-cavity 500A so as to allow airflow to traverse the outer wall 303B through the plurality of outer openings 600 into the first sub-cavity 500A.

The plurality of outer holes 400 communicate with the second sub-cavity 500B through a plurality of tubes 400A to bypass the first sub-cavity 500A, while the plurality of inner openings 402 communicate directly with the second sub-cavity 500B. The airflow traversing the outer wall 303B passes through the plurality of outer holes 400 and through the plurality of tubes 400A into the second sub-cavity 500B to allow impingement on inner wall 303A and provide circulation of airflow inside the second sub-cavity 500B to cool down the inner wall 303A that faces the combustion chamber 88. The plurality of inner openings 402 (for example, shown as being oblique in FIG. 6) are used to form a film of cooling air over the surface of inner wall 303A that faces the hot gases inside the combustion chamber 88. In addition to the plurality of outer holes 400, the plurality of inner openings 402, and the plurality of outer openings 600, the plurality of hot side planks 312A may also include a plurality of lateral holes 403 that are provided in lateral walls 303C and communicate with the second sub-cavity 500B. The plurality of outer holes 400, the plurality of inner openings 402, and the plurality of lateral holes 403 allow airflow to pass therethrough into and out of the second sub-cavity 500B to cool the inner wall 303A of the plurality of hot side planks 312A that faces the hot gases inside the combustion chamber 88. Because the inner wall 303A faces the hot gases inside the combustion chamber 88, the inner wall 303A can be provided with a thermal barrier coating (TBC) 303D.

In an embodiment, the inner wall 303A in the plurality of hot side planks 312A may also include one or more inner holes 404 connected to one or more bypass tubes 404A (resonator neck). The one or more inner holes 404 connect the first sub-cavity 500A to the combustion chamber 88. The one or more bypass tubes 404A also connect the one or more inner holes 404 to the first sub-cavity 500A while bypassing the second sub-cavity 500B. The airflow within the first sub-cavity 500A passes through the plurality of tubes 404A into the combustion chamber 88 without communicating with the second sub-cavity 500B. In an embodiment, as shown in FIG. 6, the one or more bypass tubes 404A are oblique relative to the inner wall 303A of the plurality of hot side planks 312A that faces the hot gases inside the combustion chamber 88. The one or more bypass tubes 404A can be used to tune the second sub-cavity 500B (resonator sub-cavity).

In an embodiment, the first sub-cavity 500A acts as the resonator cavity and the plurality of outer openings 600 are used to pressurize a thermo-acoustic resonator cavity. In an embodiment, the first sub-cavity 500A can act as a thermo-acoustic resonator cavity and used to dampen combustion dynamics oscillations. In an embodiment, the second sub-cavity 500B can act as a thermo-acoustic resonator cavity and used to dampen combustion dynamics oscillations. In an embodiment, a thickness of the outer wall 303B can be about 0.05 inch. In an embodiment, a thickness of the inner wall 303A is about 0.06 inch. In an embodiment, a thickness of the thermal barrier coating is about 0.02 inch. In an embodiment, a thickness of the partition wall 500C is about 0.03 inch. In an embodiment, the width of the first sub-cavity 500A is about 0.04 inch. In an embodiment, a width of the second cavity is about 0.04 inch. The dimensions can vary by +/−20% about the above specified mean values.

Figure 7:
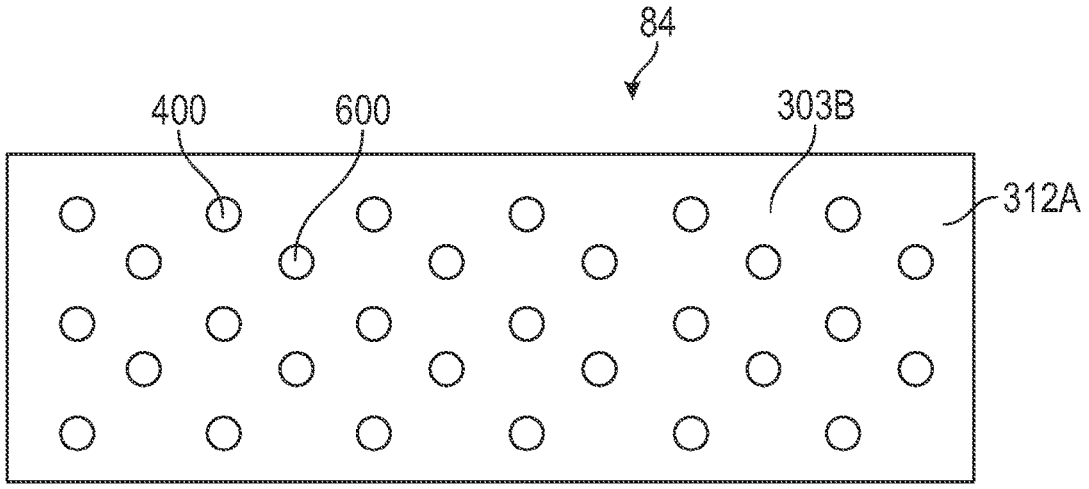
FIG. 7 is a top view of one of the plurality of planks showing a plurality of outer holes and a plurality of outer openings, according to an embodiment of the present disclosure.
Figure 8:
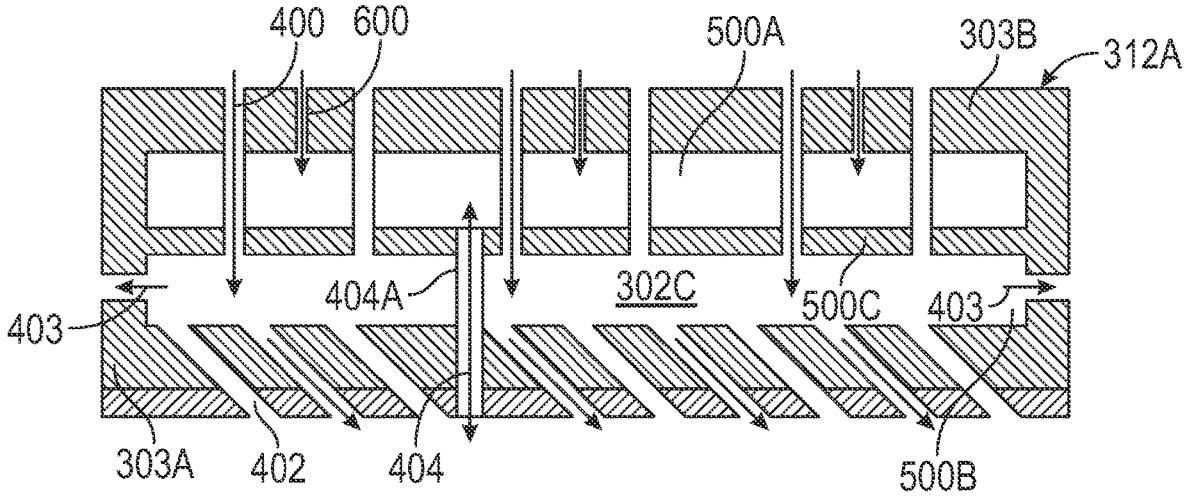
FIG. 8 is an alternative schematic cross-sectional view of one of a plurality of planks, showing the arrangement of a first sub-cavity and a second sub-cavity, according to another embodiment of the present disclosure.

FIG. 7 is a top view of one of the plurality of hot side planks 312A showing the plurality of outer holes 400 and the plurality of outer openings 600, according to an embodiment of the present disclosure. In an embodiment, the plurality of outer holes 400 and plurality of outer openings 600 can be distributed uniformly within the plurality of hot side planks 312A. In another embodiment, the plurality of outer holes 400 and plurality of outer openings 600 can be distributed non-uniformly within the plurality of hot side planks 312A FIG. 8 is a schematic cross-sectional view of one of the plurality of hot side planks 312A, showing the arrangement of the first sub-cavity 500A and the second sub-cavity 500B, according to another embodiment of the present disclosure. The embodiment shown in FIG. 8 is similar in many aspects to the embodiment shown in FIG. 7. Therefore, similar features will not be further described with reference to FIG. 8. In this embodiment, however, the one or more bypass tubes 404A (resonator neck) are substantially perpendicular relative to the inner wall 303A of the plurality of hot side planks 312A that faces the hot gases inside the combustion chamber 88.

Figure 9:
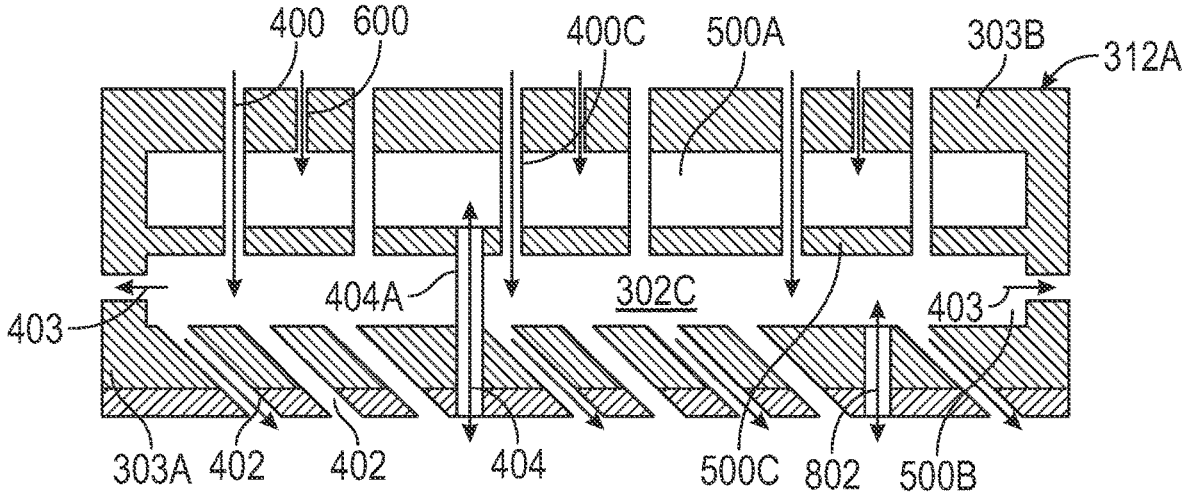
FIG. 9 is a schematic cross-sectional view of one of the plurality of planks, showing the arrangement of the first sub-cavity and the second sub-cavity, according to another embodiment of the present disclosure.

FIG. 9 is a schematic cross-sectional view of one of the plurality of hot side planks 312A, showing the arrangement of the first sub-cavity 500A and the second sub-cavity 500B, according to another embodiment of the present disclosure. The embodiment shown in FIG. 9 is similar in many aspects to the embodiment shown in FIG. 8. Therefore, similar features will not be further described with respect to FIG. 9. In this embodiment, however, in addition to the one or more bypass tubes 404A (resonator neck) and the one or more openings 402, the plurality of hot side planks 312A further include one or more second inner openings 802. The one or more second inner openings 802 communicate the second sub-cavity 500B with the combustion chamber 88. Airflow within the second sub-cavity 500B can also exit through the one or more second inner openings 802 in addition to through the plurality of inner openings 402. In an embodiment, the one or more second inner openings 802, similar to the one or more bypass tubes 404A, can also be used to tune the second sub-cavity 500B. In an embodiment, the one or more second inner openings 802 and the one or more bypass tubes 404A can be provided substantially perpendicular to the inner wall 303A of the plurality of hot side planks 312A that faces the hot gases inside the combustion chamber 88.

Figure 10:
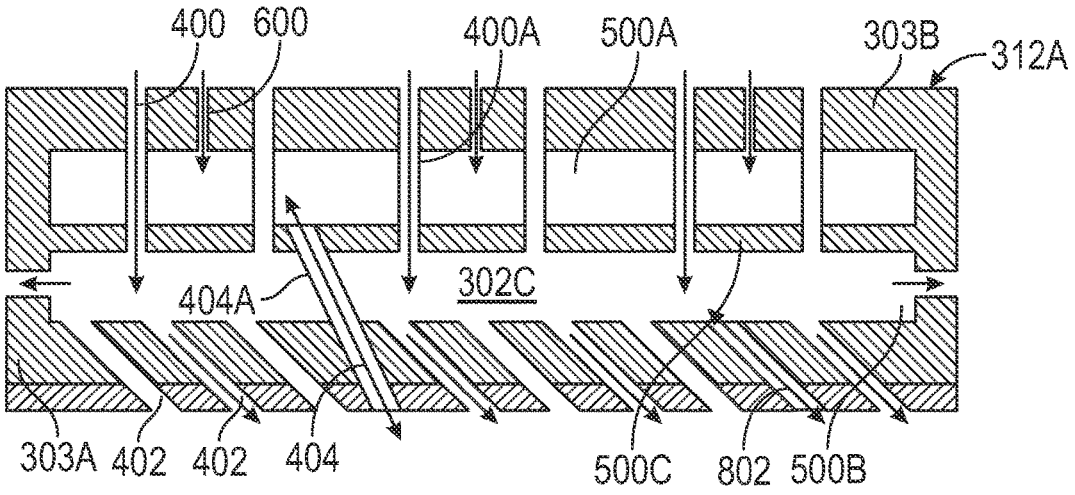
FIG. 10 is a schematic cross-sectional view of one of the plurality of planks, showing the arrangement of the first sub-cavity and the second sub-cavity, according to another embodiment of the present disclosure.

FIG. 10 is a schematic cross-sectional view of one of the plurality of hot side planks 312A, showing the arrangement of the first sub-cavity 500A and the second sub-cavity 500B, according to another embodiment of the present disclosure. The embodiment shown in FIG. 10 is similar in many aspects to the embodiment shown in FIG. 9. Therefore, similar features will not be further described with respect to FIG. 10. In this embodiment, however, the one or more second inner openings 802 and the one or more bypass tubes 404A can be provided oblique relative to the inner wall 303A of the plurality of hot side planks 312A that faces the hot gases inside the combustion chamber 88. The one or more second inner openings 802 communicate the second sub-cavity 500B with the combustion chamber 88. Airflow within the second sub-cavity 500B can also exit through the one or more second inner openings 802 in addition to through the plurality of inner openings 402. In an embodiment, the one or more second inner openings 802, similar to the one or more bypass tubes 404A, can also be used to tune the second sub-cavity 500B.

Figure 11:
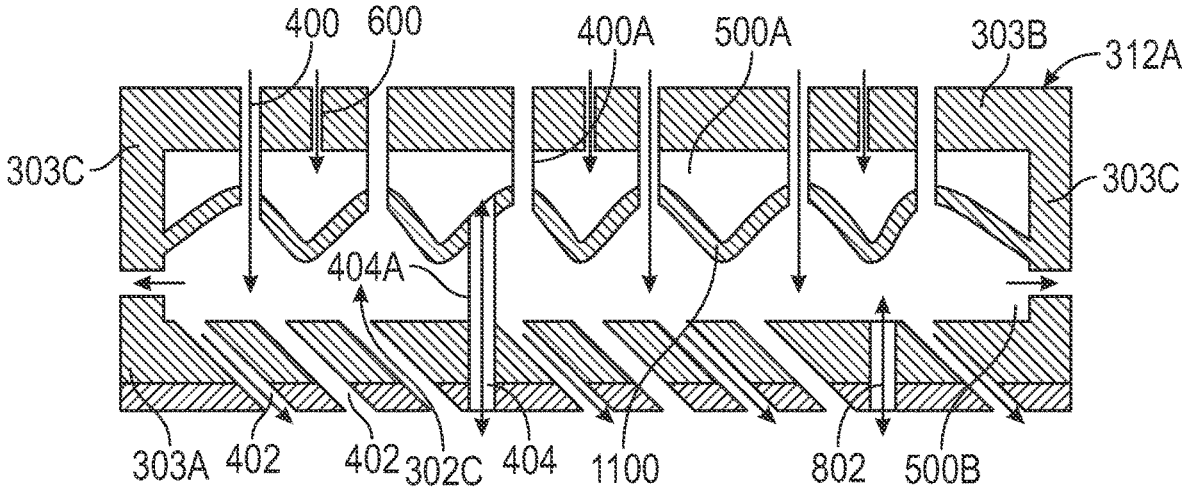
FIG. 11 is a schematic cross-sectional view of one of the plurality of planks, showing the arrangement of the first sub-cavity and the second sub-cavity, according to another embodiment of the present disclosure.

FIG. 11 is a schematic cross-sectional view of one of the plurality of hot side planks 312A, showing the arrangement of the first sub-cavity 500A and the second sub-cavity 500B, according to another embodiment of the present disclosure. The embodiment shown in FIG. 11 is similar in many aspects to the embodiment shown in FIG. 9. Therefore, similar features will not be further described with respect to FIG. 11. In this embodiment, the cavity 302C is also divided into at least the first sub-cavity 500A and the second sub-cavity 500B using a partition wall 1100 similar to the partition wall 500C of FIG. 9. The partition wall 1100 is, however, wavy or corrugated while the partition wall 500C is straight. Similar to the partition wall 500C, the partition wall 1100 is also connected to lateral walls 303C of the plurality of hot side planks 312A. The waviness of the partition wall 1100 may be further used to tune the first sub-cavity 500A (resonator cavity) and/or the second sub-cavity 500B (resonator cavity). The waviness of the partition wall 1100 may be also used to optimize impingement cooling effectiveness for cooling inner wall 303A (hot side wall) by controlling the impingement distance of the flow emanating from one or more inner holes 404 through the one or more bypass tubes 404A.

Figure 12:
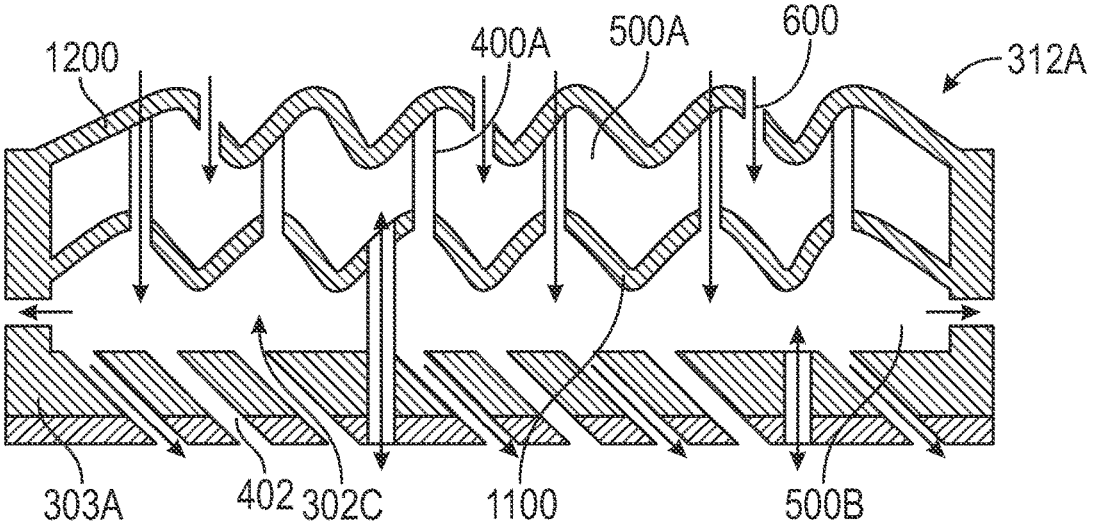
FIG. 12 is a schematic cross-sectional view of one of the plurality of planks showing the arrangement of the first sub-cavity and the second sub-cavity, according to another embodiment of the present disclosure.

FIG. 12 is a schematic cross-sectional view of one of the plurality of hot side planks 312A showing the arrangement of the first sub-cavity 500A and the second sub-cavity 500B, according to another embodiment of the present disclosure. The embodiment shown in FIG. 12 is similar in many aspects to the embodiment shown in FIG. 11. Therefore, similar features will not be further described with respect to FIG. 11. In this embodiment, the cavity 302C is also divided into at least the first sub-cavity 500A and the second sub-cavity 500B using the partition wall 1100. As shown in FIG. 12, the partition wall 1100 is also wavy or corrugated. In addition, instead of outer wall 303B (FIG. 11) that is straight, an outer wall 1200 is wavy or corrugated. The waviness of the outer wall 1200 may be further used to tune the first sub-cavity 500A (resonator cavity). In addition, the waviness of the partition wall 1100 may be further used to tune the first sub-cavity 500A (resonator cavity) and/or the second sub-cavity 500B (resonator cavity).

Figure 13:
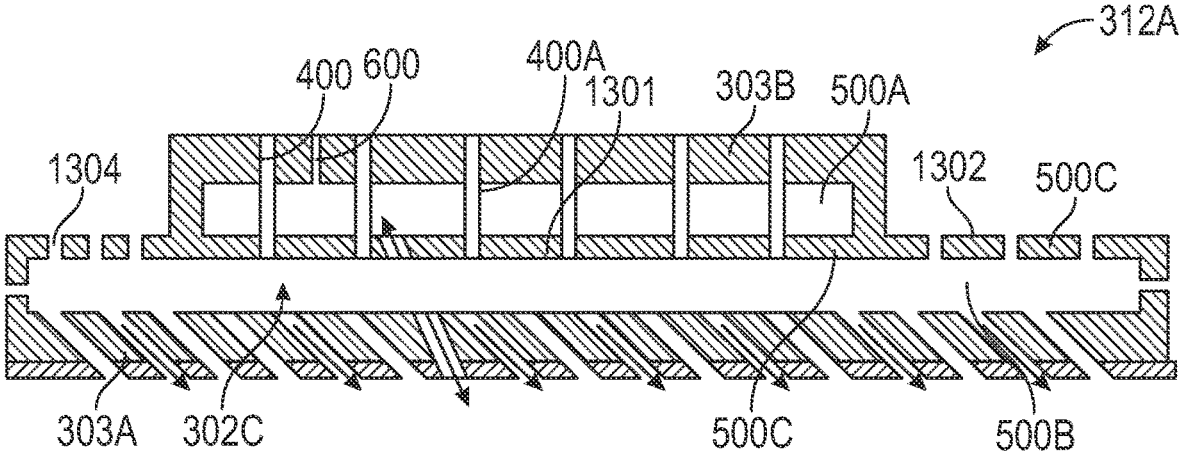
FIG. 13 is a schematic cross-sectional view of one of the plurality of planks showing the arrangement of the first sub-cavity and the second sub-cavity, according to another embodiment of the present disclosure.

FIG. 13 is a schematic cross-sectional view of one of the plurality of hot side planks 312A showing the arrangement of the first sub-cavity 500A and the second sub-cavity 500B, according to another embodiment of the present disclosure. The embodiment shown in FIG. 13 is similar in many aspects to the embodiment shown in FIG. 6. Therefore, similar features will not be further described with respect to FIG. 13. In this embodiment, the cavity 302C is also divided into at least the first sub-cavity 500A and the second sub-cavity 500B using the partition wall 500C. As shown in FIG. 13, a portion 1301 of the partition wall 500C is common to both the first sub-cavity 500A and the second sub-cavity 500B. However, another portion 1302 of the of the partition wall 500C is only a wall in the second sub-cavity 500B and not a wall in the first sub-cavity 500A. A length of the first sub-cavity 500A is less than a length of the second sub-cavity 500B. Similarly, a length of the outer wall 303B is less than a length of the inner wall 303A. In an embodiment, a plurality of holes 1304 are provided within the portion 1302 of the partition wall 500C. The plurality of holes 1304 are provided to allow airflow from outside of the plurality of hot side planks 312A into the second sub-cavity 500B of the plurality of hot side planks 312A. In addition, similar to the embodiment shown in FIG. 6, a plurality of outer holes 400 are provided with the outer wall 303B and communicate with the second sub-cavity 500B via the plurality of tubes 400A. In addition, similar to the embodiment shown in FIG. 6, a plurality of outer openings 600 are also provided within the outer wall 303B and communicate directly with the first sub-cavity 500A. By providing first sub-cavity 500A on top of the second sub-cavity 500B, as shown in FIG. 13, a volume of the first sub-cavity 500A can be selected to tune a resonance of the first sub-cavity 500A to dampen the thermo-acoustic combustion dynamics frequencies within the combustion chamber 88.

Figure 14A:
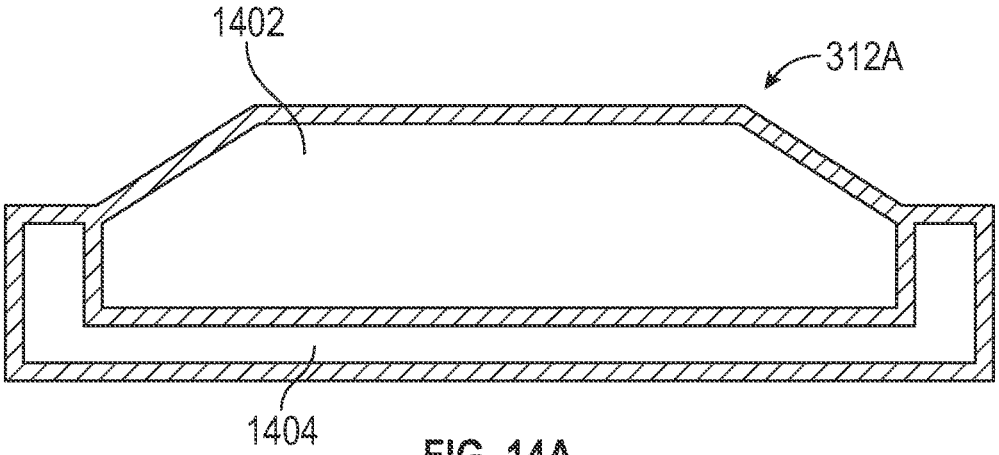
FIG. 14A is a schematic cross-sectional view of one of the plurality of planks according to another embodiment of the present disclosure.

FIG. 14A is a schematic cross-sectional view of one of the plurality of hot side planks 312A according to another embodiment of the present disclosure. As shown in FIG. 14A, the plurality of hot side planks 312A include a first sub-cavity 1402 and a second sub-cavity 1404. The first sub-cavity 1402 and the second sub-cavity may be similar to the first sub-cavity 500A and the second sub-cavity 500B, respectively. In an embodiment, as shown in FIG. 14A, the first sub-cavity 1402 can have a trapezoid cross-sectional shape, for example. However, other shapes can as also be used.

Figure 14B:
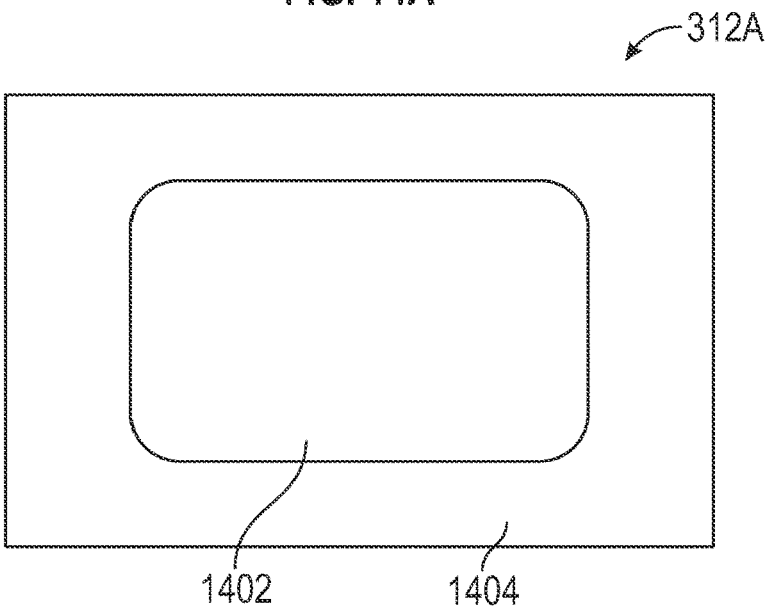
FIGS. 14B and 14C show top views of one of the plurality of planks, according to embodiments of the present disclosure.
Figure 14C:
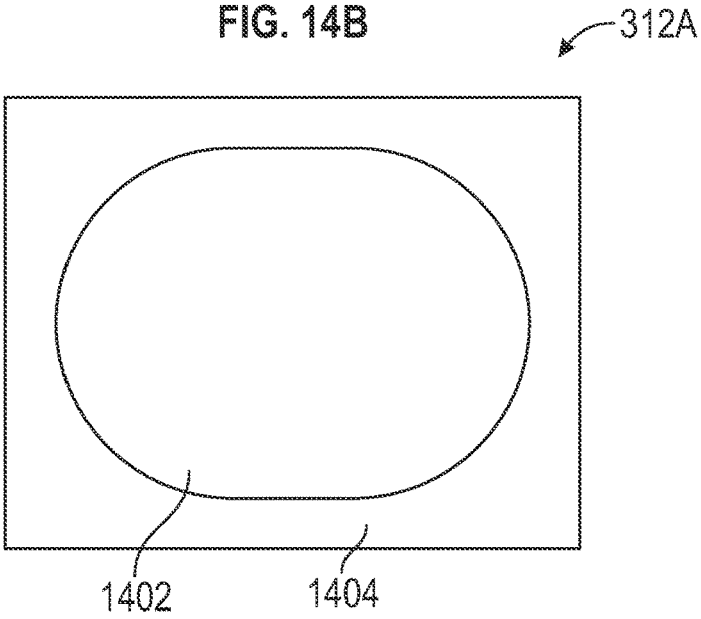

FIGS. 14B and 14C show top views of one of the plurality of hot side planks 312A, according to embodiments of the present disclosure. FIG. 14B shows a rectangular-like (e.g., with rounded corners) footprint of the first sub-cavity 1402 and a rectangular footprint of the second sub-cavity 1404. FIG. 14C shows an oval or more rounded footprint of the first sub-cavity 1402 and a rectangular footprint of the second sub-cavity 1404. Although specific footprints of the first sub-cavity 1402 and the second sub-cavity 1404 are shown, other footprint shapes can also be used.

Figure 15:
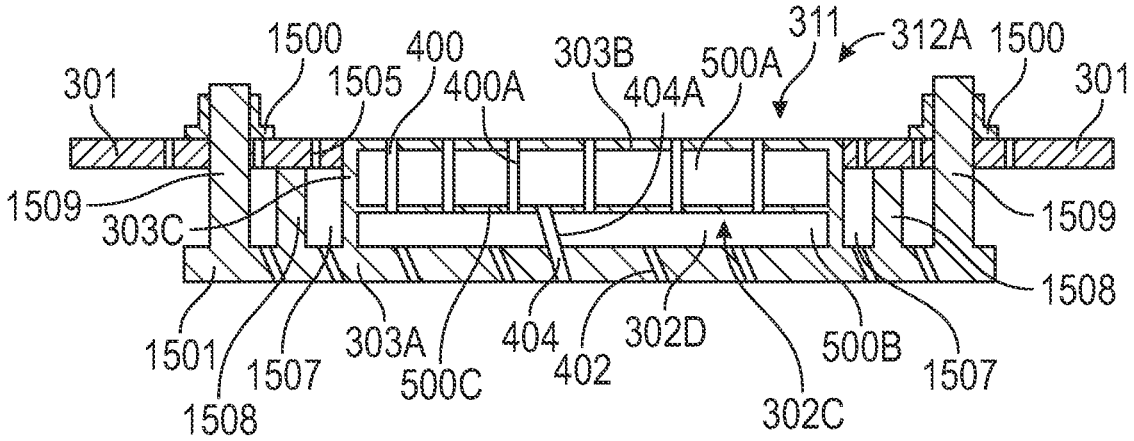
FIG. 15 is a schematic cross-sectional view of one of the plurality of planks showing the arrangement of the first sub-cavity and the second sub-cavity, according to another embodiment of the present disclosure.

FIG. 15 is a schematic cross-sectional view of one of the plurality of hot side planks 312A showing the arrangement of the first sub-cavity 500A and the second sub-cavity 500B, according to another embodiment of the present disclosure. As shown in FIG. 15, the plurality of hot side planks 312A are coupled to the skeleton mesh structure 301 using a plurality of fasteners 1500. A plurality of openings 311 are provided within the skeleton mesh structure 301 to accommodate the plurality of hot side planks 312A. The plurality of hot side planks 312A include the inner wall 303A, the outer wall 303B, and the lateral walls 303C that define the cavity 302C. For example, as shown in FIG. 15, the outer wall 303B is inserted into the opening 311 of the skeleton mesh structure 301. The opening 311 can be sized to fit the outer wall 303B. In the embodiment shown in FIG. 15, the plurality of hot side planks 312A include a plurality of structural walls (e.g., three structural walls) 1501. As shown in FIG. 15, the most outward structural wall 1509 of the structural walls 1501 is used to couple the plurality of hot side planks 312A to the skeleton mesh structure 301. The plurality of lateral walls 303C are located between the plurality of structural walls 1501.

The plurality of outer holes 400 are provided in the outer wall 303B of the plurality of hot side planks 312A. In addition to the plurality of outer holes 400, a plurality of inner openings 402 are provided in the inner wall 303A of the plurality of planks 302. In an embodiment, the plurality of outer holes 400 in the outer wall 303B of the plurality of hot side planks 312A are orthogonal holes with respect to the outer wall 303B. In an embodiment, the plurality of inner openings 402 in the inner wall 303A of the plurality of hot side planks 312A are oblique holes with respect to the inner wall 303A of the plurality of hot side planks 312A and communicate with the cavity 302C. The cavity 302C is divided into at least the first sub-cavity 500A and the second sub-cavity 500B using the partition wall 500C. In an embodiment, the partition wall 500C is connected to the lateral walls 303C. As shown in FIG. 15, a plurality of openings 1505 are provided within the skeleton mesh structure 301 to allow airflow to pass into lateral cavities 1507. The lateral cavities 1507 are defined by at least the skeleton mesh structure 301, the inner wall 303A, lateral wall 303C and structural walls 1508 and 1509. The structural walls 1508 and 1509 come in contact with the skeleton mesh structure 301.

The plurality of outer holes 400 communicate with the second sub-cavity 500B through a plurality of tubes 400A to bypass the first sub-cavity 500A, while the plurality of inner openings 402 communicate directly with the second sub-cavity 500B. The airflow traversing the outer wall 303B passes through the plurality of outer holes 400 and through the plurality of tubes 400A into the second sub-cavity 500B to allow impingement on inner wall 303A and circulation of airflow inside the second sub-cavity 500B to cool down the inner wall 303A that faces the combustion chamber 88. The plurality of inner openings 402 (for example, shown as being oblique in FIG. 15) are used to form a film of cooling air over the surface of inner wall 303A that faces the hot gases inside the combustion chamber 88.

In an embodiment, the plurality of hot side planks 312A may also include one or more bypass tubes 404A (resonator neck) connecting the first sub-cavity 500A to the combustion chamber 88. The one or more bypass tubes 404A bypass the second sub-cavity 500B. The airflow within the first sub-cavity 500A passes through the plurality of tubes 404A into the combustion chamber 88 without communicating with the second sub-cavity 500B. In an embodiment, as shown in FIG. 15, the one or more bypass tubes 404A are oblique relative to the inner wall 303A of the plurality of hot side planks 312A that faces the hot gases inside the combustion chamber 88. The one or more bypass tubes 404A can be used to tune the second sub-cavity 500B (resonator sub-cavity). In this embodiment, the first sub-cavity 500A and the second sub-cavity 500B (either can operate as the acoustic damper resonator) are provided within a cut-out of the skeleton mesh structure 301 of the inner liner 84 (shown in FIG. 2B).

Figure 16:
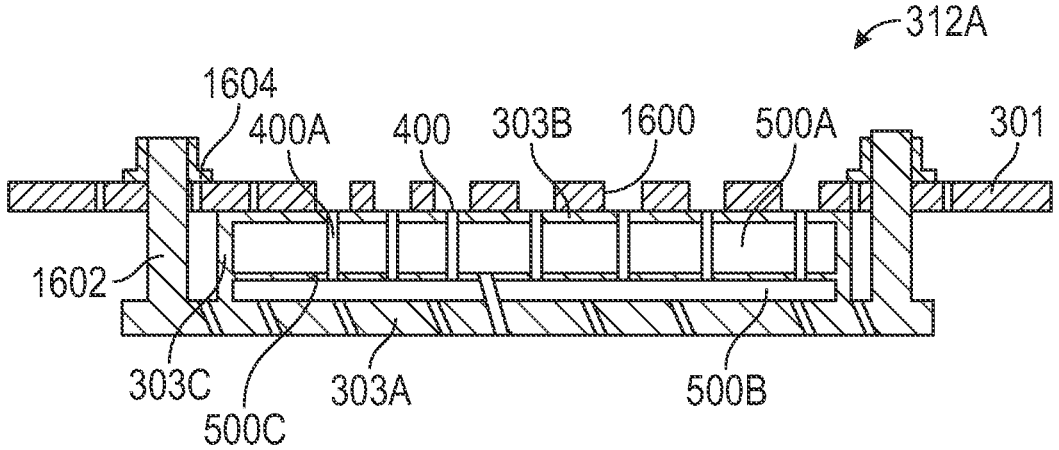
FIG. 16 is a schematic cross-sectional view of one of the plurality of planks showing the arrangement of the first sub-cavity and the second sub-cavity, according to another embodiment of the present disclosure.

FIG. 16 is a schematic cross-sectional view of one of the plurality of hot side planks 312A showing the arrangement of the first sub-cavity 500A and the second sub-cavity 500B, according to another embodiment of the present disclosure. The embodiment shown in FIG. 16 is similar in many aspects to the embodiment shown in FIG. 15. Therefore, common features will not be described further herein. Instead of the openings 311 provided within the skeleton mesh structure 301 to accommodate the plurality of hot side planks 312A, a plurality of holes 1600 are provided within the skeleton mesh structure 301 to fluidly communicate with the plurality of outer holes 400 provided in the outer wall 303B of the plurality of hot side planks 312A that are connected to the plurality of tubes 400A used to bypass the first sub-cavity 500A. The plurality of hot side planks 312A are coupled to the skeleton mesh structure 301 using support members 1602 and fasteners 1604. In this embodiment, the first sub-cavity 500A and the second sub-cavity 500B are defined by the inner wall 303A, the outer wall 303B, the lateral walls 303C, and the partition wall 500C. The lateral walls 303C are provided between the support members 1602. In this embodiment, the first sub-cavity 500A and the second sub-cavity 500B (either or both can operate as the acoustic damper resonator) are provided within skeleton mesh structure 301 of the inner liner 84 (shown in FIG. 2B).

Figure 17:
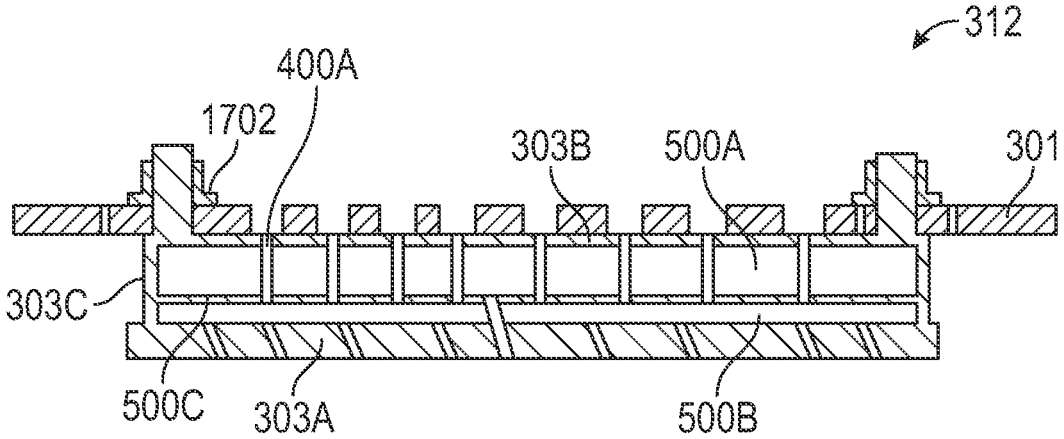
FIG. 17 is a schematic cross-sectional view of one of the plurality of planks showing the arrangement of the first sub-cavity and the second sub-cavity, according to another embodiment of the present disclosure.

FIG. 17 is a schematic cross-sectional view of one of the plurality of hot side planks 312A, showing the arrangement of the first sub-cavity 500A and the second sub-cavity 500B, according to another embodiment of the present disclosure. The embodiment shown in FIG. 17 is similar in many aspects to the embodiment shown in FIG. 16. In this embodiment, the first sub-cavity 500A and the second sub-cavity 500B are defined by the inner wall 303A, the outer wall 303B and the lateral walls 303C. The lateral walls 303C are used as a support member and connected to the skeleton mesh structure 301 of the inner liner 84 using a plurality of fasteners 1702. In this embodiment, the first sub-cavity 500A and the second sub-cavity 500B (either or both can operate as the acoustic damper resonator) are coupled to the skeleton mesh structure 301 of the inner liner 84 (shown in FIG. 2B).

The above various features are described with respect to the one or more of the plurality of hot side planks 312A. However, alternatively or in addition, any one or more of the various features described above with respect to the one or more of the plurality of hot side planks 312A can also be provided in the one or more of the plurality of hot side planks 302A. The one or more of the plurality of hot side planks 312A and the one or more of the plurality of hot side planks 302A can be referred to generally as a hollow plank.

As it can be appreciated from the above paragraphs, the cavity within the hollow plank can be divided into two or more sub-cavities. For example, the cavity within the hollow plank can be divided into the first sub-cavity 500A and the second cavity 500B. For example, the first sub-cavity 500A and/or the second sub-cavity 500B can act as a thermo-acoustic resonator cavity. Holes, openings and/or bypass tubes provided within the hollow cavity can be used to frequency tune the first sub-cavity 500A and/or the second sub-cavity 500B to reduce combustion dynamic frequencies or pressure oscillations. In an embodiment, each plank can be provided with the cavities to provide the acoustic damping arrangement. In another embodiment, a selected number of planks can be provided with the cavities to provide the acoustic damping arrangement.

Further aspects are provided by the subject matter of the following clauses:

A hollow plank of a combustor liner that defines a combustion chamber includes an inner wall having a plurality of inner openings and one or more inner holes, an outer wall having one or more outer openings and a plurality of outer holes, a plurality of lateral walls coupled to the inner wall and the outer wall to define a cavity, and a partition wall connected to the plurality of lateral walls and dividing the cavity into a first sub-cavity and a second sub-cavity. The outer wall, the partition wall, and the plurality of lateral walls define the first sub-cavity. The inner wall, the partition wall, and the plurality of lateral walls define the second sub-cavity. The one or more outer openings in the outer wall communicate with the first sub-cavity. The plurality of outer holes in the outer wall communicate through a plurality of tubes with the second sub-cavity to bypass the first sub-cavity. The plurality of inner openings in the inner wall communicate with the second sub-cavity. The one or more inner holes in the inner wall communicate with the first sub-cavity through one or more bypass tubes to bypass the second sub-cavity. The first sub-cavity or the second sub-cavity or both are frequency tuned to reduce combustion dynamic frequencies.

The hollow plank according to the preceding clause, the one or more inner holes together with the one or more bypass tubes being configured to tune the first sub-cavity to dampen the combustion dynamic frequencies.

The hollow plank according to any preceding clause, the inner wall including a thermal barrier coating (TBC) to protect the inner wall from hot gases inside the combustion chamber.

The hollow plank according to any preceding clause, the plurality of outer holes in the outer wall being orthogonal or oblique with respect to the outer wall.

The hollow plank according to any preceding clause, the one or more outer openings in the outer wall being orthogonal or oblique with respect to the outer wall.

The hollow plank according to any preceding clause, the plurality of inner openings in the inner wall being orthogonal or oblique with respect to the inner wall.

The hollow plank according to any preceding clause, the one or more bypass tubes being perpendicular or oblique with respect to the inner wall.

The hollow plank according to any preceding clause, the inner wall further including one or more second inner openings provided to frequency tune the second sub-cavity.

The hollow plank according to any preceding clause, the one or more second inner openings being orthogonal or oblique with respect to the inner wall.

The hollow plank according to any preceding clause, the plurality of lateral walls including a plurality of lateral holes that communicate with the second sub-cavity.

The hollow plank according to any preceding clause, the partition wall being wavy.

The hollow plank according to any preceding clause, the outer wall being wavy. The hollow plank according to any preceding clause, the first sub-cavity having a trapezoid cross-sectional shape.

The hollow plank according to any preceding clause, the first sub-cavity having a rectangular-like footprint or an oval footprint.

The hollow plank according to any preceding clause, the hollow plank having a wall coupled to a skeleton mesh structure using a plurality of fasteners.

The hollow plank according to any preceding clause, further comprising a plurality of lateral cavities and a plurality of openings are provided with the skeleton mesh structure to allow airflow to pass into the plurality of lateral cavities.

The hollow plank according to any preceding clause, wherein the hollow plank is accommodated within an opening provided within the skeleton mesh structure.

The hollow plank according to any preceding clause, wherein the hollow plank is coupled to the skeleton mesh structure such that a plurality of holes provided within the skeleton mesh structure fluidly communicate with the plurality of outer holes provided in the outer wall of the hollow plank.

The hollow plank according to any preceding clause, wherein the lateral walls lateral walls 303C are connected to the skeleton mesh structure using a plurality of fasteners.

A combustor includes a combustor liner defining a combustion chamber. The combustor liner includes a skeleton mesh structure, and a plurality of hollow planks coupled to the skeleton mesh structure. One or more of the plurality of hollow planks includes an inner wall having a plurality of inner openings and one or more inner holes, an outer wall having a one or more outer openings and a plurality of outer holes, a plurality of lateral walls coupled to the inner wall and the outer wall to define a cavity, and a partition wall connected to the plurality of lateral walls and dividing the cavity into a first sub-cavity and a second sub-cavity. The outer wall, the partition wall, and the plurality of lateral walls define the first sub-cavity. The inner wall, the partition wall, and the plurality of lateral walls define the second sub-cavity. The one or more outer openings in the outer wall communicate with the first sub-cavity. The plurality of outer holes in the outer wall communicate through a plurality of tubes with the second sub-cavity to bypass the first sub-cavity. The plurality of inner openings in the inner wall communicate with the second sub-cavity. The one or more inner holes in the inner wall communicate with the first sub-cavity through one or more bypass tubes to bypass the second sub-cavity. The first sub-cavity or the second sub-cavity or both are frequency tuned to reduce combustion dynamic frequencies generated with the combustion chamber.

The combustor according to the preceding clause, the one or more inner holes together with the one or more bypass tubes being configured to tune the first sub-cavity to damp the combustion dynamic frequencies.

The combustor according to any preceding clause, the inner wall including a thermal barrier coating (TBC) to protect the inner wall from hot gases inside the combustion chamber.

The combustor according to any preceding clause, the plurality of outer holes in the outer wall being orthogonal or oblique with respect to the outer wall.

The combustor according to any preceding clause, the one or more outer openings in the outer wall being orthogonal or oblique with respect to the outer wall.

The combustor according to any preceding clause, the plurality of inner openings in the inner wall being orthogonal or oblique with respect to the inner wall.

The combustor according to any preceding clause, the one or more bypass tubes being perpendicular or oblique with respect to the inner wall.

The combustor according to any preceding clause, the inner wall further including one or more second inner openings provided to frequency tune the second sub-cavity.

The combustor according to any preceding clause, the one or more second inner openings being orthogonal or oblique with respect to the inner wall.

The combustor according to any preceding clause, the plurality of lateral walls including a plurality of lateral holes that communicate with the second sub-cavity.

The combustor according to any preceding clause, the partition wall being wavy.

The combustor according to any preceding clause, the outer wall being wavy.

The combustor according to any preceding clause, the skeleton mesh structure including a plurality of openings to accommodate a plurality of hot side planks.

The combustor according to any preceding clause, the skeleton mesh structure including a plurality of holes in fluid communication with the plurality of outer holes in the outer wall.

Although the foregoing description is directed to the preferred embodiments of the present disclosure, other variations and modifications will be apparent to those skilled in the art, and may be made without departing from the spirit or the scope of the disclosure. Moreover, features described in connection with one embodiment of the present disclosure may be used in conjunction with other embodiments, even if not explicitly stated above.

The invention claimed is:

1. A hollow plank of a combustor liner that defines a combustion chamber, the hollow plank comprising:

an inner wall having a plurality of inner openings and one or more inner holes;

an outer wall having one or more outer openings and a plurality of outer holes;

a plurality of lateral walls coupled to the inner wall and the outer wall to define a cavity; and a partition wall connected to the plurality of lateral walls, provided between the inner wall and the outer wall, and dividing the cavity into a first sub-cavity and a second sub-cavity, wherein the outer wall, the partition wall, and the plurality of lateral walls define the first sub-cavity, and the inner wall, the partition wall, and the plurality of lateral walls define the second sub-cavity, wherein the one or more outer openings in the outer wall communicate with the first sub-cavity, wherein the plurality of outer holes in the outer wall communicate through a plurality of tubes with the second sub-cavity to bypass the first sub-cavity, wherein the plurality of inner openings in the inner wall communicate with the second sub-cavity, wherein the one or more inner holes in the inner wall communicate with the first sub-cavity through one or more bypass tubes to bypass the second sub-cavity, and wherein the first sub-cavity or the second sub-cavity or both are frequency tuned to reduce combustion dynamic frequencies.

2. The hollow plank according to claim 1, wherein the one or more inner holes together with the one or more bypass tubes are provided to tune the first sub-cavity to dampen the combustion dynamic frequencies.

3. The hollow plank according to claim 1, wherein the inner wall comprises a thermal barrier coating (TBC) to protect the inner wall from hot gases inside the combustion chamber.

4. The hollow plank according to claim 1, wherein the plurality of outer holes in the outer wall are orthogonal with respect to the outer wall.

5. The hollow plank according to claim 1, wherein the one or more outer openings in the outer wall are orthogonal with respect to the outer wall.

6. The hollow plank according to claim 1, wherein the plurality of inner openings in the inner wall are oblique with respect to the inner wall.

7. The hollow plank according to claim 1, wherein the one or more bypass tubes are perpendicular or oblique with respect to the inner wall.

8. The hollow plank according to claim 1, wherein the plurality of lateral walls comprises a plurality of lateral holes that communicate with the second sub-cavity.

9. The hollow plank according to claim 1, wherein the inner wall further comprises one or more second inner openings provided to frequency tune the second sub-cavity.

10. The hollow plank according to claim 9, wherein the one or more second inner openings are orthogonal or oblique with respect to the inner wall.

11. A combustor comprising:

a combustor liner defining a combustion chamber, the combustor liner comprising:

a skeleton mesh structure; and a plurality of hollow planks coupled to the skeleton mesh structure, one or more of the plurality of hollow planks comprising:

an inner wall having a plurality of inner openings and one or more inner holes;

an outer wall having one or more outer openings and a plurality of outer holes;

a plurality of lateral walls coupled to the inner wall and the outer wall to define a cavity; and a partition wall connected to the plurality of lateral walls, provided between the inner wall and the outer wall, and dividing the cavity into a first sub-cavity and a second sub-cavity, wherein the outer wall, the partition wall, and the plurality of lateral walls define the first sub-cavity, and the inner wall, the partition wall, and the plurality of lateral walls define the second sub-cavity, wherein the one or more outer openings in the outer wall communicate with the first sub-cavity, wherein the plurality of outer holes in the outer wall communicate through a plurality of tubes with the second sub-cavity to bypass the first sub-cavity, wherein the plurality of inner openings in the inner wall communicate with the second sub-cavity, wherein the one or more inner holes in the inner wall communicate with the first sub-cavity through one or more bypass tubes to bypass the second sub-cavity, and wherein the first sub-cavity or the second sub-cavity or both are frequency tuned to reduce combustion dynamic frequencies generated with the combustion chamber.

12. The combustor according to claim 11, wherein the one or more inner holes together with the one or more bypass tubes are configured to tune the first sub-cavity to damp the combustion dynamic frequencies.

13. The combustor according to claim 11, wherein the inner wall comprises a thermal barrier coating (TBC) to protect the inner wall from hot gases inside the combustion chamber.

14. The combustor according to claim 11, wherein the plurality of outer holes in the outer wall are orthogonal with respect to the outer wall.

15. The combustor according to claim 11, wherein the one or more outer openings in the outer wall are orthogonal with respect to the outer wall.

16. The combustor according to claim 11, wherein the plurality of inner openings in the inner wall are oblique with respect to the inner wall.

17. The combustor according to claim 11, wherein the one or more bypass tubes are perpendicular or oblique with respect to the inner wall.

18. The combustor according to claim 11, wherein the plurality of lateral walls comprises a plurality of lateral holes that communicate with the second sub-cavity.

19. The combustor according to claim 11, wherein the inner wall comprises one or more second inner openings provided to frequency tune the second sub-cavity.

20. The combustor according to claim 19, wherein the one or more second inner openings are orthogonal or oblique with respect to the inner wall.

* * * * *